US011842680B2

(12) United States Patent
Kawabe et al.

(10) Patent No.: US 11,842,680 B2
(45) Date of Patent: Dec. 12, 2023

(54) SEMICONDUCTOR DEVICE AND ELECTRONIC APPARATUS

(71) Applicant: Sharp Semiconductor Innovation Corporation, Tenri (JP)

(72) Inventors: Isamu Kawabe, Tenri (JP); Takahiro Inoue, Tenri (JP); Takayuki Shimizu, Tenri (JP); Kohji Hamaguchi, Tenri (JP); Tetsuro Ikeda, Tenri (JP)

(73) Assignee: Sharp Semiconductor Innovation Corporation, Tenri (JP)

( * ) Notice: Subject to any disclaimer, the term of this patent is extended or adjusted under 35 U.S.C. 154(b) by 0 days.

(21) Appl. No.: 17/988,744

(22) Filed: Nov. 16, 2022

(65) Prior Publication Data

US 2023/0162671 A1 May 25, 2023

(30) Foreign Application Priority Data

Nov. 19, 2021 (JP) ..... 2021-188892

(51) Int. Cl.
*G09G 3/3225* (2016.01)

(52) U.S. Cl.
CPC ..... *G09G 3/3225* (2013.01); *G09G 2360/144* (2013.01); *G09G 2360/145* (2013.01); *G09G 2360/16* (2013.01)

(58) Field of Classification Search
CPC ..... G09G 3/3225; G09G 2360/144; G09G 2360/145; G09G 2360/16; G09G 2310/0237
See application file for complete search history.

(56) References Cited

U.S. PATENT DOCUMENTS

| | | | | |
|---|---|---|---|---|
| 9,449,561 | B1 * | 9/2016 | Umansky | G09G 5/003 |
| 2008/0248837 | A1 * | 10/2008 | Kunkel | G09G 3/3406 455/566 |
| 2021/0056896 | A1 | 2/2021 | Greimel-Langauer et al. | |
| 2021/0210027 | A1 * | 7/2021 | Chen | G01J 1/4204 |
| 2023/0100161 | A1 * | 3/2023 | Zhou | G09G 5/10 345/207 |

* cited by examiner

*Primary Examiner* — Antonio Xavier
(74) *Attorney, Agent, or Firm* — ScienBiziP, P.C.

(57) ABSTRACT

A semiconductor device includes the following: a light measuring instrument disposed opposite the display surface of a display panel provided with a self-emission element, and disposed for measuring the ambient-light illuminance of the display panel; a storage device configured to store a plurality of first measurements measured by the light measuring instrument in synchronization with a synchronizing signal of the display panel during a plurality of first measurement periods that are shorter than an ON/OFF period of the self-emission element; and a calculation unit configured to calculate the light emission illuminance of the self-emission element in accordance with the plurality of first measurements stored in the storage device, and configured to calculate the ambient-light illuminance by subtracting a value based on the light emission illuminance from a second measurement measured by the light measuring instrument during a second measurement period that is longer than the plurality of first measurement periods.

9 Claims, 12 Drawing Sheets

2 : DISPLAY PANEL
3 : SEMICONDUCTOR DEVICE
4 : LIGHT MEASURING INSTRUMENT
9 : SUBSTRATE
10 : TFT LAYER
11 : ORGANIC EL LAYER
12 : COVER GLASS

2: DISPLAY PANEL
3: SEMICONDUCTOR DEVICE
4: LIGHT MEASURING INSTRUMENT
9: SUBSTRATE
10: TFT LAYER
11: ORGANIC EL LAYER
12: COVER GLASS
23: AMBIENT LIGHT
24: REFLECTED LIGHT

SEMICONDUCTOR DEVICE AND ELECTRONIC APPARATUS

CROSS-REFERENCE TO RELATED APPLICATION

The present application claims priority from Japanese Application JP2021-188892, the content of which is hereby incorporated by reference into this application.

BACKGROUND OF THE INVENTION

1. Field of the Invention

The present invention relates to a semiconductor device and an electronic apparatus that include a light measuring instrument disposed on the backside of a display panel for measuring the ambient-light illuminance of the display panel.

2. Description of the Related Art

An illuminance sensor that measures ambient-light illuminance is used for regulating the brightness of a smartphone's display. Although such an illuminance sensor has been conventionally disposed above the display to measure the ambient-light illuminance, it has been eventually disposed on the backside (back surface or under display) of the smartphone's display because of upsizing of the smartphone's display and changing into entire-surface display.

The illuminance sensor, when disposed on the display's backside, is irradiated with ambient light as well as light emitted from the display. Thus, ambient light needs to be determined by subtracting display's light from a result output from the illuminance sensor.

A known electronic apparatus (United States Patent Application Publication No. 2021/0056896) includes a display, and a light sensor disposed on the display's backside to receive ambient light that has passed through the display. The electronic apparatus calculates the ambient-light illuminance on the basis of a first-subframe count value and a second-subframe count value, obtained by integrating a first sub-frame modulated by at least one modulation parameter and a second sub-frame modulated by at least one modulation parameter with respect to incident light in the light sensor between vertical synchronizing signals of the display.

SUMMARY OF THE INVENTION

Such a conventional technique as described above unfortunately does not reflect the ON/OFF timing of the light emission in the display.

Display's light cannot be hence subtracted accurately, making it difficult to calculate more accurate ambient-light illuminance.

One aspect of the present invention aims to achieve a semiconductor device and an electronic apparatus that can calculate more accurate ambient-light illuminance.

To solve the above problem, a semiconductor device according to one aspect of the present invention includes the following: a light measuring instrument disposed opposite the display surface of a display panel provided with a self-emission element, and disposed for measuring the ambient-light illuminance of the display panel; a storage device configured to store a plurality of first measurements measured by the light measuring instrument in synchronization with a synchronizing signal of the display panel during a plurality of first measurement periods that are shorter than an ON/OFF period of the self-emission element; and a calculation unit configured to calculate the light emission illuminance of the self-emission element in accordance with the plurality of first measurements stored in the storage device, and configured to calculate the ambient-light illuminance by subtracting a value based on the light emission illuminance from a second measurement measured by the light measuring instrument during a second measurement period that is longer than the plurality of first measurement periods.

To solve the above problem, a semiconductor device according to one aspect of the present invention includes the following: a light measuring instrument disposed opposite the display surface of a display panel provided with a self-emission element, and disposed for measuring the ambient-light illuminance of the display panel; a storage device configured to store a plurality of first measurements measured by the light measuring instrument in synchronization with a synchronizing signal of the display panel during a first measurement period that is shorter than an ON/OFF period of the self-emission element, and a communication interface configured to calculate the light emission illuminance of the self-emission element in accordance with the plurality of first measurements, and configured to send the plurality of first measurements and a second measurement for subtracting a value based on the light emission illuminance from the second measurement measured by the light measuring instrument during a second measurement period that is longer than the first measurement period.

To solve the above problem, an electronic apparatus according to one aspect of the present invention includes the following: a display panel provided with a self-emission element; and a semiconductor device disposed opposite the display surface of the display panel, wherein the semiconductor device includes the following: a light measuring instrument for measuring the ambient-light illuminance of the display panel; a storage device configured to store a plurality of first measurements measured by the light measuring instrument in synchronization with a synchronizing signal of the display panel during a first measurement period that is shorter than an ON/OFF period of the self-emission element; and a calculation unit configured to calculate the light emission illuminance of the self-emission element in accordance with the plurality of first measurements stored in the storage device, and configured to calculate the ambient-light illuminance by subtracting a value based on the light emission illuminance from a second measurement measured by the light measuring instrument during a second measurement period that is longer than the first measurement period.

To solve the above problem, a method for measuring ambient-light illuminance according to one aspect of the present invention is for measuring the ambient-light illuminance of a display panel provided with a self-emission element. The method includes the following process steps: storing, in a storage device, a plurality of first measurements measured by a light measuring instrument disposed opposite the display surface of the display panel in synchronization with a synchronizing signal of the display panel during a first measurement period that is shorter than an ON/OFF period of the self-emission element; and calculating the light emission illuminance of the self-emission element in accordance with the plurality of first measurements stored in the storage device, and calculating the ambient-light illuminance by subtracting a value based on the light emission illuminance from a second measurement measured by the light measuring instrument during a second measurement period that is longer than the first measurement period.

To solve the above problem, a non-transitory computer-readable medium according to one aspect of the present invention stores a program based on the method for measuring the ambient-light illuminance according to one aspect of the present invention.

The aspects of the present invention can offer a semiconductor device and an electronic apparatus that can calculate more accurate ambient-light illuminance.

DETAILED DESCRIPTION OF THE INVENTION

First Preferred Embodiment

The following details one embodiment of the present invention.

Figure 1:
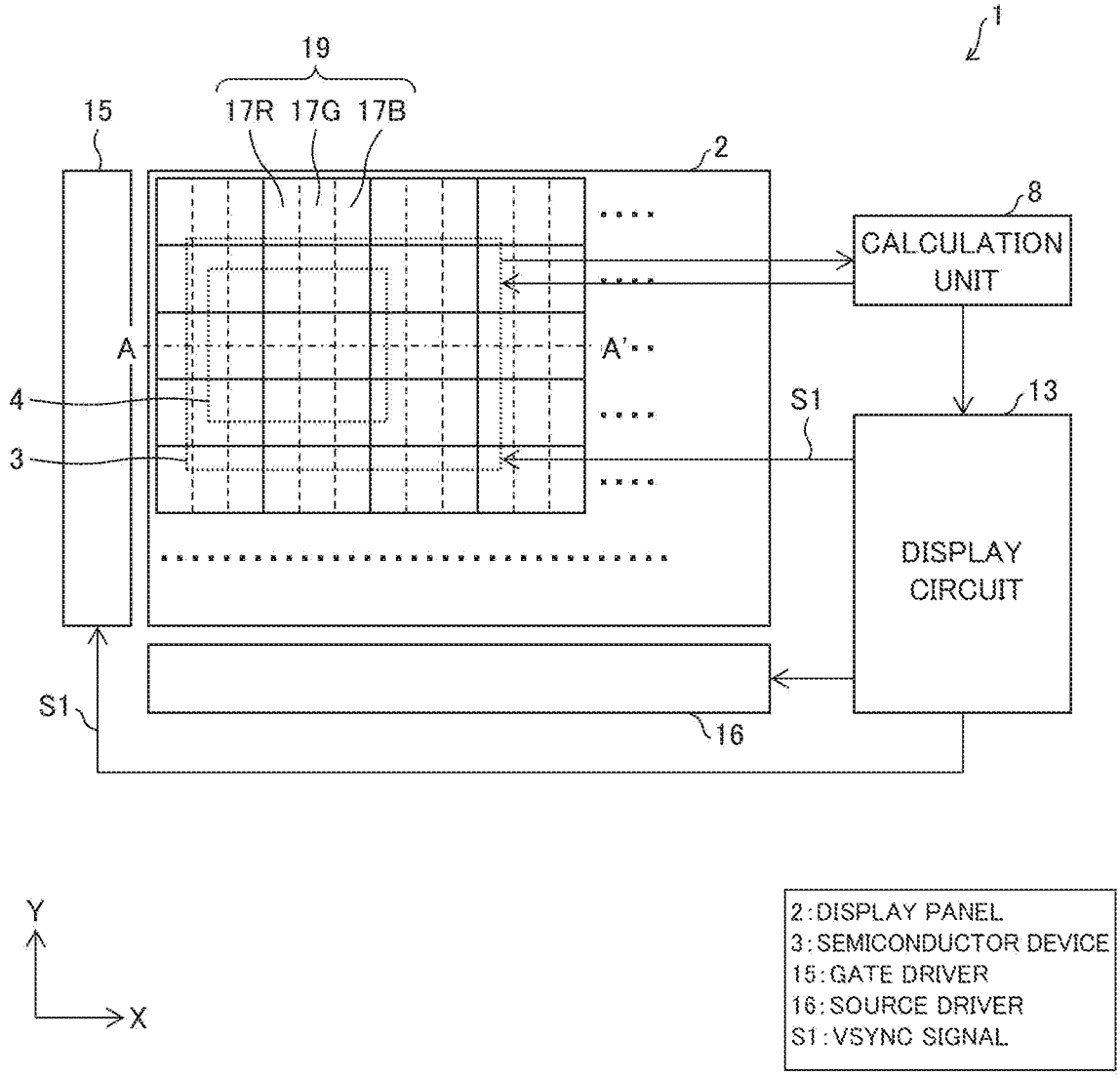
FIG. 1 is a plan view of an electronic apparatus according to a first preferred embodiment.
Figure 2:
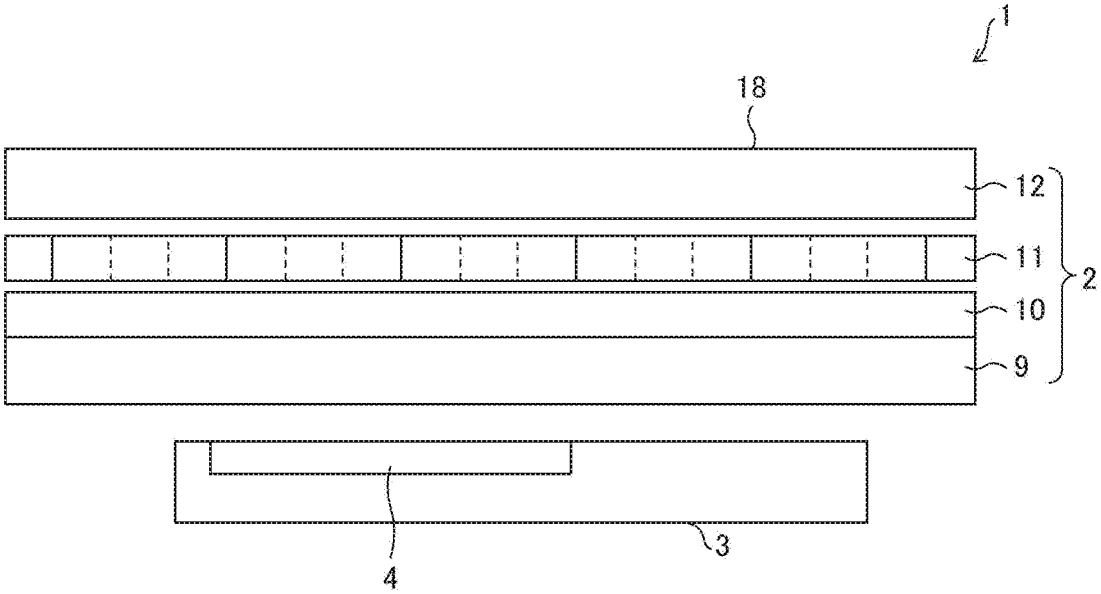
FIG. 2 is a sectional view taken along line A-A' shown in FIG. 1.

FIG. 1 is a plan view of an electronic apparatus 1 according to the first preferred embodiment. FIG. 2 is a sectional view taken along line A-A' shown in FIG. 1.

The electronic apparatus 1 includes a display panel 2, and a semiconductor device 3 disposed opposite a display surface 18 of the display panel 2. The electronic apparatus 1 can be, but not limited to, a portable electronic apparatus, such as a smartphone, a game machine or a watch, or can be, but not limited to, an image display device, such as a TV set, a personal computer or a monitor. The display panel 2 has the following: a substrate 9; a thin-film transistor (TFT) layer 10 formed on the substrate 9; an organic electroluminescence (EL) layer 11 formed on the TFT layer 10; and cover glass 12 formed on the organic EL layer 11.

The organic EL layer 11 has a plurality of pixels 19 disposed in rows and columns in X- and Y-directions. Each pixel 19 includes a red light-emitting element 17R (self-emission element), a green light-emitting element 17G (self-emission element) and a blue light-emitting element 17B (self-emission element) arranged in the X-direction.

The display panel 2 further has the following: a gate driver 15 for controlling the operation timing of the individual light-emitting elements 17R, 17G and 17B; a source diver 16 for supplying display data to each of the light-emitting elements 17R, 17G and 17B; and a display circuit 13 that supplies, to the gate driver 15 and semiconductor device 3, a vertical synchronizing signal (VSYNC) S1 (synchronizing signal) for controlling the operation timing, a signal that is indicative of a light emission duty of each of the light-emitting elements 17R, 17G and 17B, and other things, and that supplies a display signal for each of the light-emitting elements 17R, 17G and 17B to the source driver 16. The light emitters 17R, 17G and 17B each can be an organic light-emitting diode (OLED) for instance.

Figure 3:
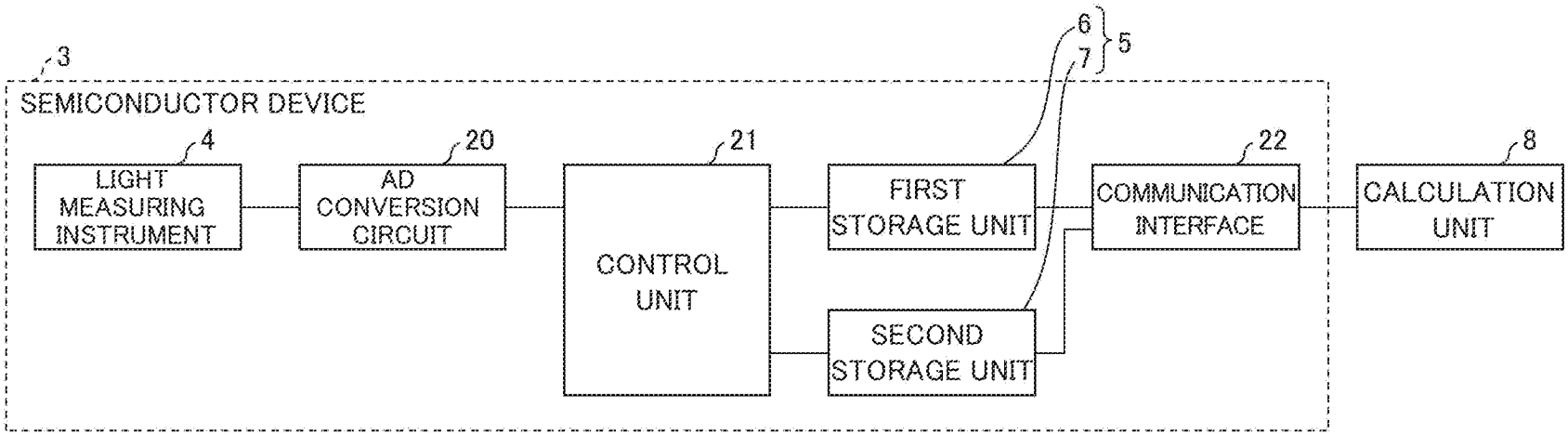
FIG. 3 is a block diagram of a semiconductor device provided in the electronic apparatus.

FIG. 3 is a block diagram of the semiconductor device 3 provided in the electronic apparatus 1.

The semiconductor device 3 has the following: a light measuring instrument 4 for measuring the ambient-light illuminance of the display panel 2; a storage device 5 for storing measurements measured by the light measuring instrument 4; an AD-conversion circuit 20 that AD-converts the measurements measured by the light measuring instrument 4; a control unit 21 that writes the measurements undergone AD-conversion by the AD-conversion circuit 20 into the storage device 5; and a communication interface 22 that reads the measurements stored in the storage device 5 to send them to the display circuit 13, which controls the display panel 2. The display circuit 13 sends a control signal for controlling the luminance of each of the light-emitting elements 17R, 17G and 17B to the source driver 16. The communication interface 22 is in conformance with an inter-integrated circuit (I2C) or a serial peripheral interface (SPI) for instance.

Figure 4:
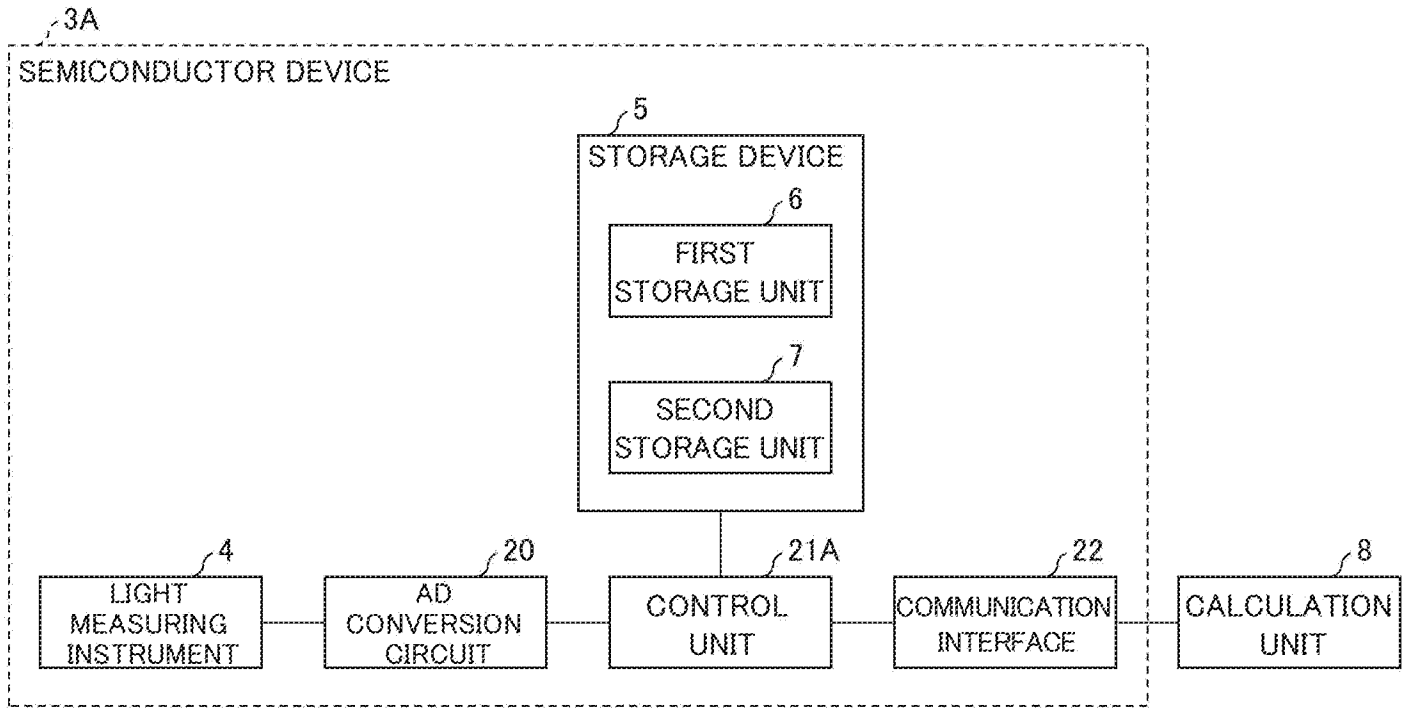
FIG. 4 is a block diagram of a modification of the semiconductor device.

It is noted that although the foregoing has described an instance where the communication interface 22 reads the measurements stored in the storage device 5, the present invention is not limited to this instance. The control unit 21 may read the measurements. FIG. 4 is a block diagram of a semiconductor device 3A according to a modification. Components similar to those previously described will be denoted by similar reference signs. The detailed description of these components will not be repeated.

The semiconductor device 3A includes a control unit 21A. The control unit 21A, when reading the measurements stored in the storage device 5, can write and read the measurements into and from the storage device 5 and can send, to the communication interface 22, the measurements read from the storage device 5, as illustrated in FIG. 4.

The light measuring instrument 4 may or may not be provided for each of the plurality of pixels 19.

The storage device 5 includes the following: a first storage unit 6 that stores a first measurement measured by the light measuring instrument 4 in synchronization with the vertical synchronizing signal S1 of the display panel 2 during a first measurement period T1 (FIG. 6) that is shorter than an ON/OFF period of each of the light-emitting elements 17R, 17G and 17B; and a second storage unit 7 that stores a second measurement measured by the light measuring instrument 4 during a second measurement period T2 (FIG. 6) that is longer than the first measurement period T1. The first storage unit 6 includes a memory array.

The display panel 2 has a calculation unit 8 that calculates the light emission illuminance of each of the light-emitting elements 17R, 17G and 17B in accordance with the first measurement, and that calculates the ambient-light illuminance by subtracting a value based on the light emission illuminance from the second measurement measured by the light measuring instrument 4 during the second measurement period T2.

It is noted that the calculation unit 8 may be incorporated in the semiconductor device 3, as described later on in FIG. 9 and FIG. 10.

Figure 5:
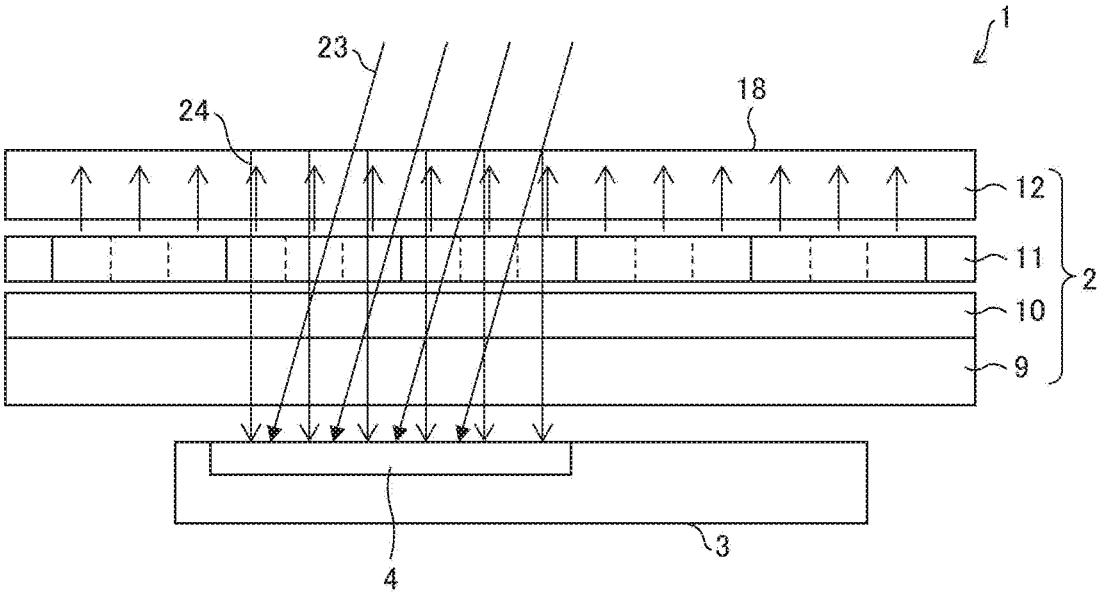
FIG. 5 illustrates, in a sectional view, the relationship between ambient light of the display panel provided in the electronic apparatus and light emitted from a self-emission element.

FIG. 5 illustrates, in a sectional view, the relationship between ambient light 23 of the display panel 2 provided in the electronic apparatus 1 and reflected light 24 of the display panel 2.

The light measuring instrument 4 of the semiconductor device 3 receives the ambient light 23 of the display panel 2 passed through the display panel 2, and the reflected light 24 emitted from each of the light-emitting elements 17R, 17G and 17B of the display panel 2 and reflected on the cover glass 12. This unfortunately causes the light emission illuminance of each of the light-emitting elements 17R, 17G and 17B to overlap the ambient-light illuminance that is to be originally measured by the light measuring instrument 4.

Figure 6:
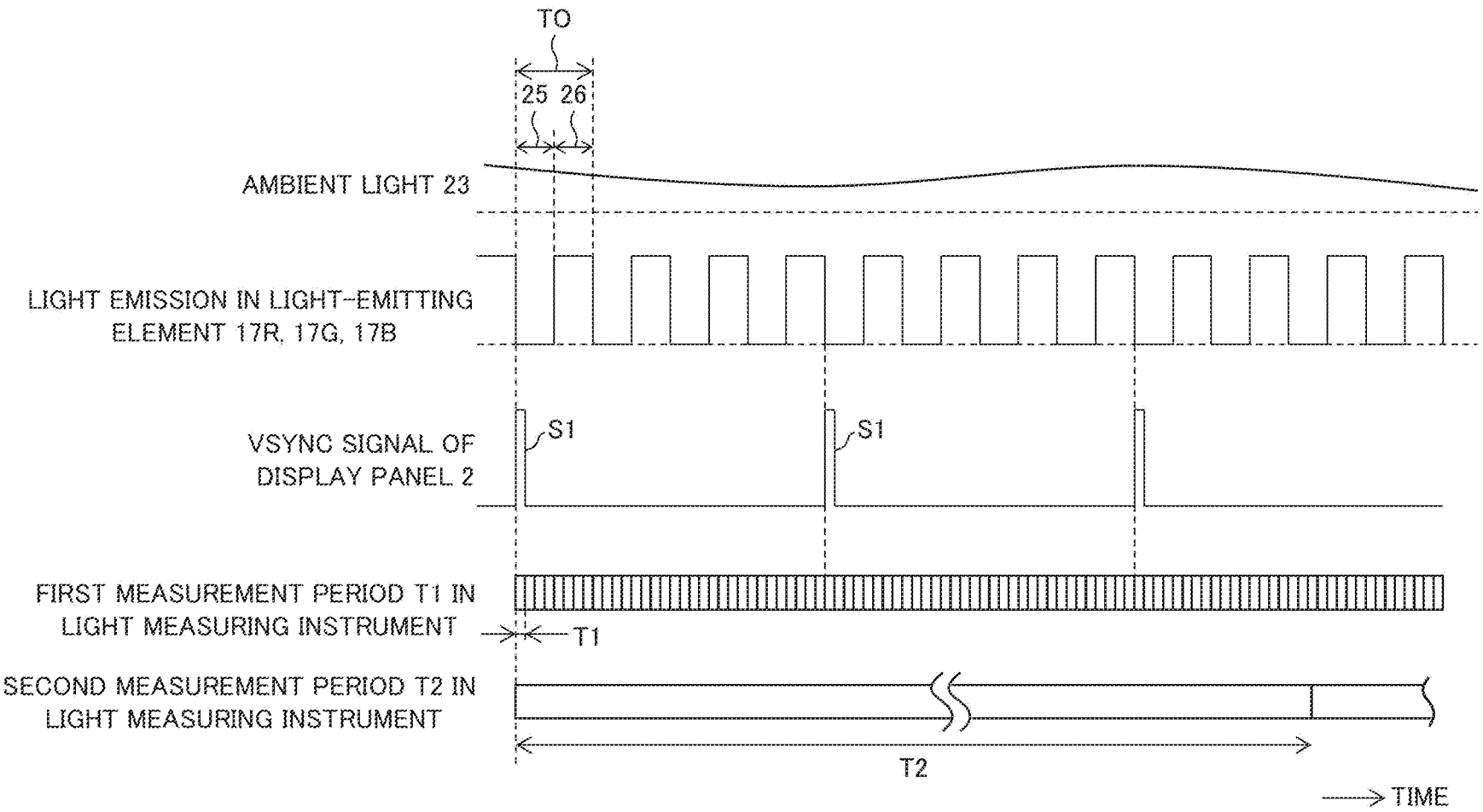
FIG. 6 is a graph for describing a measurement period in a light measuring instrument provided in the semiconductor device.
Figure 7:
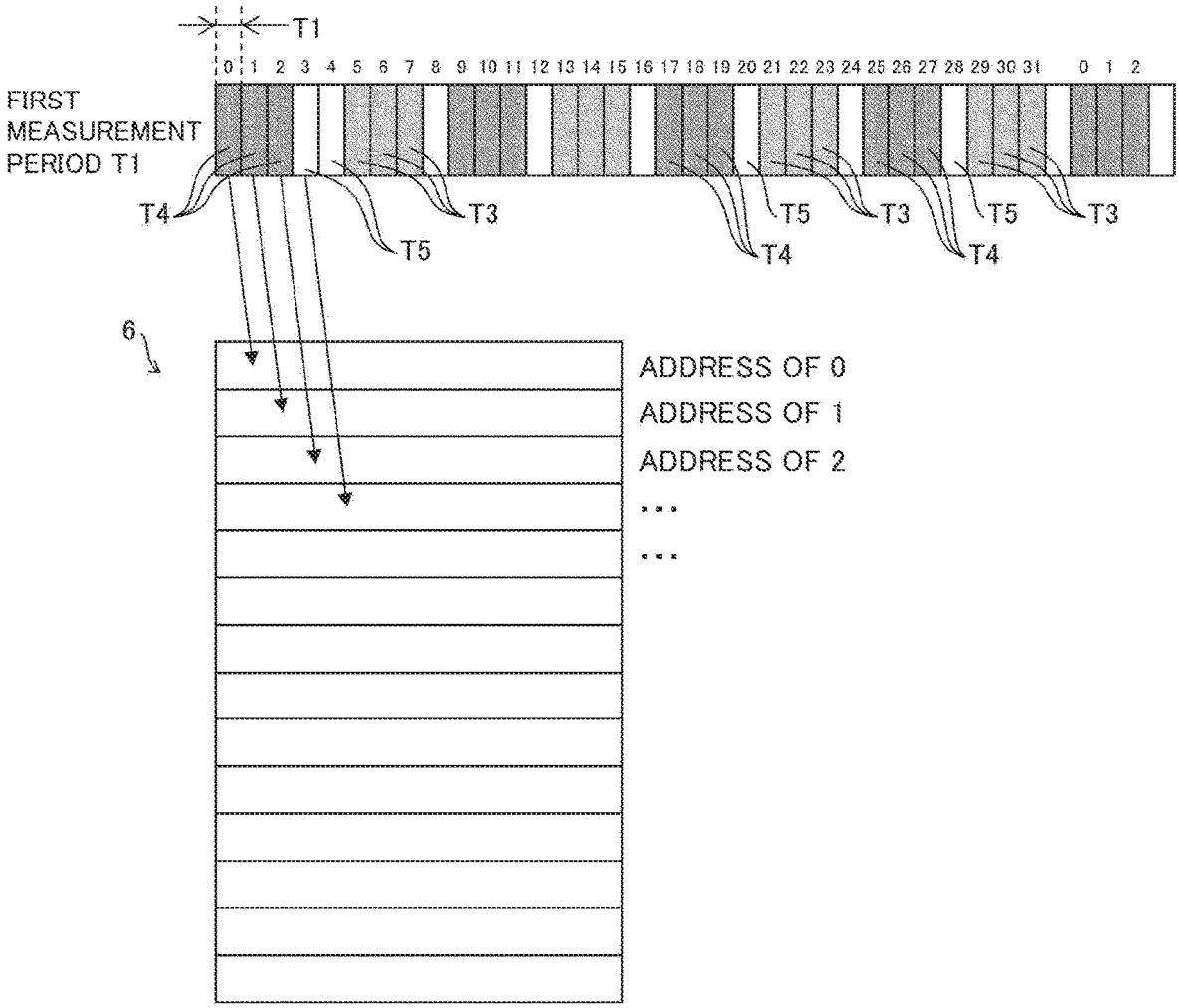
FIG. 7 schematically illustrates an aspect where measured data measured during the measurement period is stored in a storage device provided in the semiconductor device.
Figure 8:
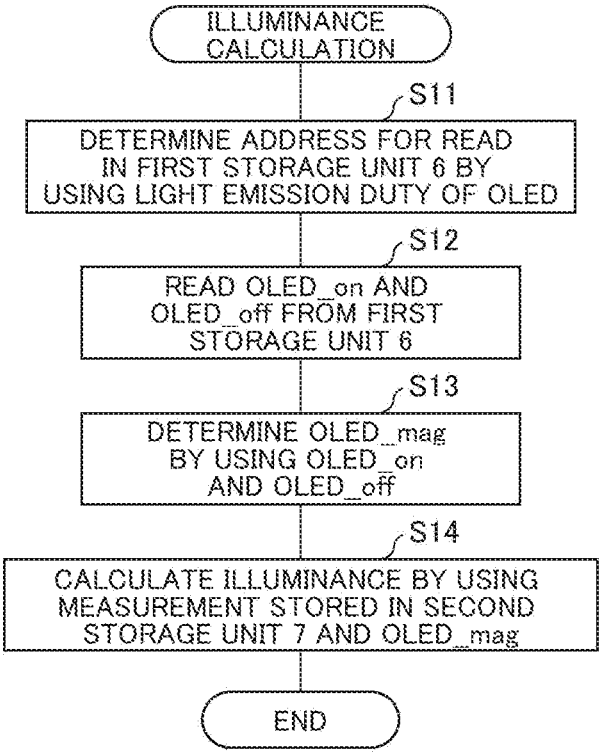
FIG. 8 is a flowchart showing the operation of the electronic apparatus.

FIG. 6 is a graph for describing the first measurement periods T1 and second measurement period T2 in the light measuring instrument 4 provided in the semiconductor device 3. FIG. 7 schematically illustrates an aspect where measured data measured during the first measurement periods T1 is stored in the storage device 5 provided in the semiconductor device 3. FIG. 8 is a flowchart showing the operation of the electronic apparatus 1.

The light measuring instrument 4 measures first measurements in synchronization with the vertical synchronizing signal S1 (synchronizing signal) of the display panel 2 during the first measurement periods T1 that are shorter than an ON/OFF period TO of each of the light-emitting elements 17R, 17G and 17B.

The ON/OFF period TO includes an OFF period 25 during which the light emission of each of the light-emitting elements 17R, 17G and 17B remains off, and an ON period 26 during which the light emission remains on. During the OFF period 25, only the ambient light 23 from outside the display panel 2 enters the light measuring instrument 4. During the ON period 26, the reflected light 24 based on light emitted from each of the light-emitting elements 17R, 17G and 17B is added to the ambient light 23 and then enters the light measuring instrument 4. FIG. 6 illustrates an instance where the light emission in each of the light-emitting elements 17R, 17G and 17B during the OFF period 25 remains off completely.

As such, only the ambient light 23 enters the light measuring instrument 4 when the first measurement periods T1 are included in the OFF period 25. The reflected light 24 is added to the ambient light 23 and then enters the light measuring instrument 4 when the first measurement periods T1 are included in the ON period 26. Whether each of the plurality of first measurement periods T1 is included in the OFF period 25 or the ON period 26 can be identified on the basis of the ON/OFF period TO and the light emission duty that is indicative of the ratio between the OFF period 25 and the ON period 26.

The luminance of the display panel 2 is controlled by the light emission duty of each of the light-emitting elements 17R, 17G and 17B. Further, the control unit 21 of the semiconductor device 3 can identify, based on a signal supplied from the display circuit 13 and indicative of the light emission duty, which address in the first storage unit 6 each first measurement with each of the light-emitting elements 17R, 17G and 17B remaining on is stored in, as well as which address in the first storage unit 6 each first measurement with each of the light-emitting elements 17R, 17G and 17B remaining off is stored in.

It is noted that the horizontal broken line relating to the ambient light 23 in FIG. 6 indicates the level of complete darkness where the illuminance of the ambient light 23 stands at zero lux.

The AD-conversion circuit 20 then AD-converts the first measurements measured by the light measuring instrument 4 and then supplies the first measurements to the control unit 21. The control unit 21 next stores the first measurements supplied from the AD-conversion circuit 20 in the first storage unit 6 of the storage device 5 in order from the start address.

Each address of the first storage unit 6 does not correspond to the pixel 19 of the light-emitting elements 17R, 17G and 17B. It is common to provide the light measuring instrument 4 that is larger than the pixel 19 of the light-emitting elements 17R, 17G and 17B. The first storage unit 6 stores the first measurements corresponding to the amount of light entered the light measuring instrument 4, irrespective of the number of pixels 19.

As describes above, the first storage unit 6 stores the first measurements in order from the start address, which is an address of 0, in synchronization with the vertical synchronizing signal S1 during the first measurement periods T1. Upon occurrence of the next vertical synchronizing signal S1, the first measurements are overwritten again from the start address.

For instance, when a first measurement period T1 that synchronizes with the vertical synchronizing signal S1 is repeated 32 times from the zeroth first measurement period T1 to the thirty-first first measurement period T1, as illustrated in FIG. 7, the zeroth to second first measurement periods T1 are OFF measurement periods T4 during which the light emission in each of the light-emitting elements 17R, 17G and 17B remains off. Moreover, the fifth to seventh first measurement periods T1 are ON measurement periods T3 during which the light emission remains on. The ninth to eleventh first measurement periods T1 are OFF measurement periods T4, during which the light emission remains off. The thirteenth to fifteenth first measurement periods T1 are ON measurement periods T3, during which the light emission remains on. The seventeenth to nineteenth first measurement periods T1 are OFF measurement periods T4, during which the light emission remains off. The twenty-first to twenty-third first measurement periods T1 are ON measurement periods T3, during which the light emission remains on. The twenty-fifth to twenty-seventh first measurement periods T1 are OFF measurement periods T4, during which the light emission remains off. The twenty-ninth to thirty-first first measurement periods T1 are ON measurement periods T3, during which the light emission remains on.

It is noted that the remaining third, fourth, eighth, twelfth, sixteenth, twentieth, twenty-fourth and twenty-eighth first measurement periods T1 indicate transient measurement periods T5 during which the light emission possibly switches from the ON state to the OFF state, or from the OFF state to the ON state. Thus, the measurements during these transient periods cannot be used in calculation.

Further, the light measuring instrument 4 measures the second measurement during the second measurement period T2, which is longer than the first measurement periods T1.

Moreover, the AD-conversion circuit 20 AD-converts the second measurement measured by the light measuring instrument 4 and then supplies the second measurement to the control unit 21. The control unit 21 next stores the second measurement supplied from the AD-conversion circuit 20 in the second storage unit 7 of the storage device 5.

The second storage unit 7 stores the second measurement measured during the second measurement period T2. The second measurement is overwritten in the second storage unit 7 every time the second measurement is measured.

Moreover, the communication interface 22 sends the first measurements stored in the first storage unit 6 and the second measurement stored in the second storage unit 7 to the calculation unit 8.

The calculation unit 8 next calculates the light emission illuminance of each of the light-emitting elements 17R, 17G and 17B on the basis of the first measurements sent from the communication interface 22 and calculates the ambient-light illuminance by subtracting a value based on the light emission illuminance from the second measurement sent from the communication interface 22.

The calculation unit 8 calculates the light emission illuminance of each of the light-emitting elements 17R, 17G and 17B by subtracting, based on the light emission duty of each of the light-emitting elements 17R, 17G and 17B, the first measurements with each light-emitting element remaining off from the first measurements with each light-emitting element reaming on.

The first storage unit 6 stores a measurement where the reflected light 24 based on each of the light-emitting elements 17R, 17G and 17B during the first measurement periods T1 and the ambient light 23 during the first measurement periods T1 are added. The second storage unit 7 stores a measurement where the reflected light 24 based on each of the light-emitting elements 17R, 17G and 17B during the second measurement period T2 and the ambient light 23 during the second measurement period T2 are added. However, a measurement of the ambient light 23 is stored during the zeroth to second first measurement periods T1, the ninth to eleventh first measurement periods T1, the seventeenth to nineteenth first measurement periods T1 and the twenty-fifth to twenty-seventh first measurement periods T1, in all of which each of the light-emitting elements 17R, 17G and 17B does not emit light.

The control unit 21 determines address information for reading first measurement information from the first storage unit 6 by reflecting ON/OFF information based on the light emission duty of each of the light-emitting elements 17R, 17G and 17B. For instance, the control unit 21 determines address information for identifying which address each first measurement with each light-emitting element remaining off are stored in, and which address each first measurement with each light-emitting element remaining on are stored in.

The control unit 21 reads the first measurements from the first storage unit 6 by using the determined address information.

The control unit 21 defines a first measurement (e.g., the first measurement in an address of 6 of the first storage unit 6) with each of the light-emitting elements 17R, 17G and 17B remaining on as OLED_ON and identifies its address with the light-emitting element remaining on. The control unit 21 also defines a first measurement (e.g., the first measurement in an address of 1 of the first storage unit 6) with each of the light-emitting elements 17R, 17G and 17B remaining off as OLED_OFF and identifies its address with the light-emitting element remaining off.

The calculation unit 8 preferably calculates an average value of the first measurements read from the respective addresses of OLED_ON in the first storage unit 6. The calculation unit 8 also preferably calculates an average value of the first measurements read from the respective addresses of OLED_OFF in the first storage unit 6. Accordingly, a more stable OLED_ON value and a more stable OLED_OFF value can be determined.

The calculation unit 8 determines OLED_mag, which indicates the light emission intensity of each of the light-emitting elements 17R, 17G and 17B, through Expression 1 below by using the first measurements with each light-emitting element remaining on, and the first measurements with each light-emitting element remaining off.

$$\text{OLED_mag}=\text{OLED_on}-\text{OLED_off} \qquad \text{Expression 1}$$

The calculation unit 8 also determines the ambient-light illuminance through Expression 2 below.

$$\text{Ambient-light illuminance}=\text{measurement in second storage unit}-\text{OLED_mag}\times(\text{second measurement period } T2/(\text{first measurement period } T1\times 2)) \qquad \text{Expression 2}$$

The calculation unit 8 calculates the light emission illuminance of each of the light-emitting elements 17R, 17G and 17B by subtracting, based on the light emission duty of each of the light-emitting elements 17R, 17G and 17B, the first measurements with each of the light-emitting elements 17R, 17G and 17B remaining off from the first measurements with each of the light-emitting elements 17R, 17G and 17B remaining on.

The ON/OFF period T0 includes the ON period 26, during which each of the light-emitting elements 17R, 17G and 17B remains on, and the OFF period 25, during which each of the light-emitting elements 17R, 17G and 17B remains off.

Some of the plurality of first measurement periods T1 are ON measurement periods T3 for measurement during the ON period 26. Some of the plurality of first measurement periods T1 are OFF measurement periods T4 for measurement during the OFF period 25. The remaining first measurement periods T1 are transient measurement periods T5, during which the ON period 26 possibly switches to the OFF period 25, or the OFF period 25 possibly switches to the ON period 26.

The first storage unit 6 stores the plurality of first measurements in order from the start address.

Moreover, the calculation unit 8 calculates the light emission illuminance of each of the light-emitting elements 17R, 17G and 17B by subtracting the first measurements measured during the OFF measurement periods T4 from the first measurements measured during the ON measurement periods T3.

The calculation unit 8 calculates the ambient-light illuminance by subtracting a value based on the light emission illuminance, first measurement periods T1 and second measurement period T2 from the second measurement.

FIG. 8 is a flowchart showing the operation of the electronic apparatus 1.

Firstly, the first measurements are measured by the light measuring instrument 4 during the first measurement periods T1 in synchronization with the vertical synchronizing signal S1 of the display panel 2. The control unit 21 then stores the first measurements in the first storage unit 6 in order from the start address.

Next, the second measurement is measured by the light measuring instrument 4 during the second measurement period T2 in synchronization with the vertical synchronizing signal S1. The control unit 21 stores the second measurement in the second storage unit 7. The second measurement period T2 may last for equal to or shorter than the interval between the vertical synchronizing signals S1 or may last for longer than the interval between the vertical synchronizing signals S1. Indoor light typically undergoes superimposition of oscillations of 100 Hz or 120 Hz, which is double the commercial power supply frequency, i.e., 50 Hz or 60 Hz; accordingly, the influence of the oscillations of this frequency can be eliminated when the second measurement period T2 is set at 100 ms.

Next (Step S11), the control unit 21 determines addresses for read in the first storage unit 6 by using the light emission duty of each of the light-emitting elements 17R, 17G and 17B.

Then (Step S12), the control unit 21 reads the first measurements OLED_ON and the first measurements OLED_OFF from the first storage unit 6 and reads the second measurement from the second storage unit 7.

The communication interface 22 then sends the first measurements OLED_ON, first measurements OLED_OFF and second measurement read by the control unit 21 to the calculation unit 8.

Next (Step S13), the calculation unit 8 determines the light emission intensity OLED_mag of each of the light-emitting elements 17R, 17G and 17B on the basis of the first measurements OLED_ON and the first measurements OLED_OFF sent from the communication interface 22.

Then (Step S14), the calculation unit 8 calculates the ambient-light illuminance through foregoing Expression 2 by using the second measurement sent from the communication interface 22, and the light emission intensity OLED_mag of each of the light-emitting elements 17R, 17G and 17B.

Figure 9:
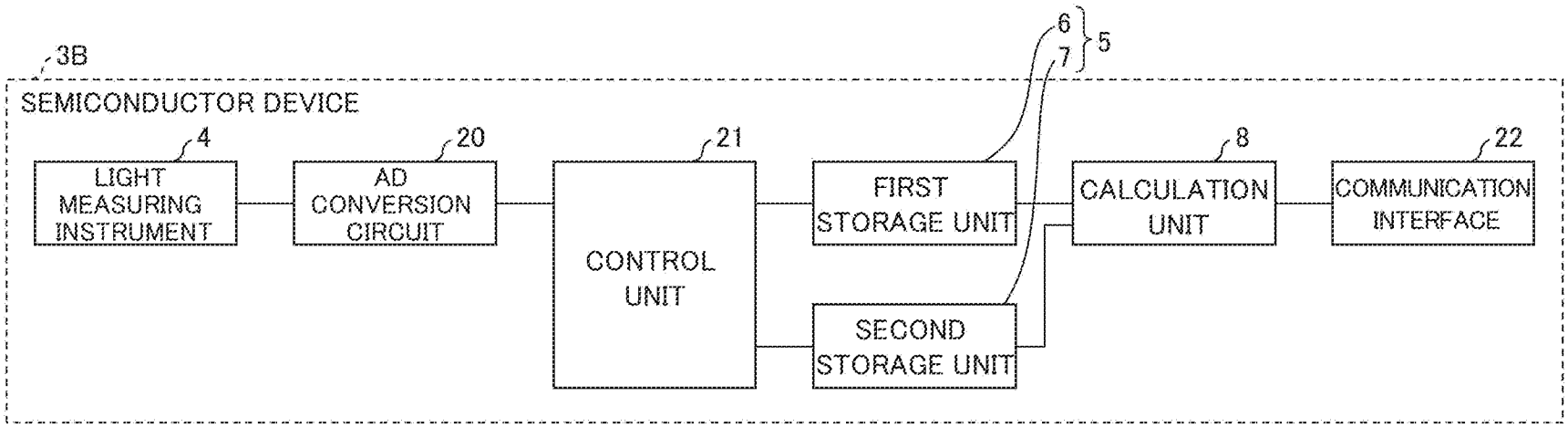
FIG. 9 is a block diagram of another modification of the semiconductor device.

FIG. 9 is a block diagram of a semiconductor device 3B according to another modification. Components similar to those previously described will be denoted by similar reference signs. The detailed description of these components will not be repeated.

The semiconductor device 3B includes the calculation unit 8. The calculation unit 8 calculates the light emission illuminance of each of the light-emitting elements 17R, 17G and 17B in accordance with first measurements stored in the first storage unit 6 and calculates the ambient-light illuminance by subtracting a value based on the light emission illuminance from a second measurement stored in the second storage unit 7. The communication interface 22 sends the ambient-light illuminance calculated by the calculation unit 8 to the display circuit 13, which controls the display panel 2.

As described above, the calculation unit 8 may be provided in the semiconductor device 3A instead of the display panel 2.

Figure 10:
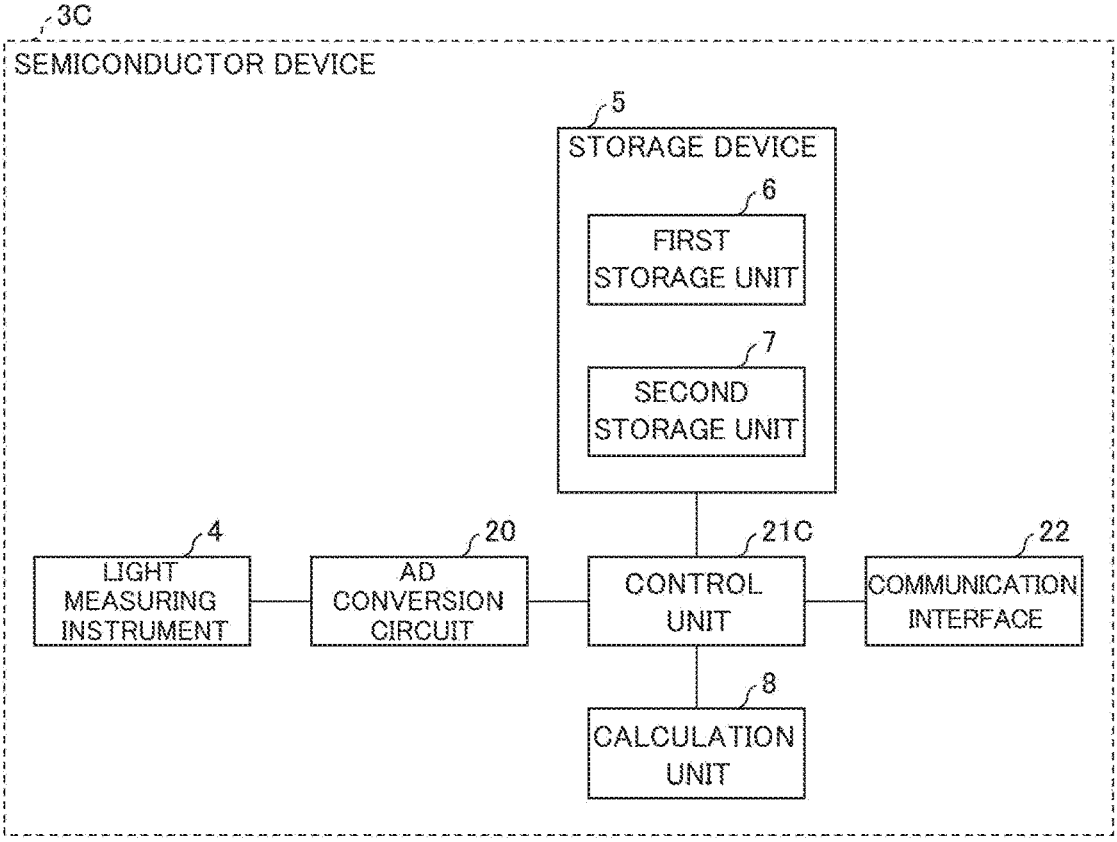
FIG. 10 is a block diagram of further another modification of the semiconductor device.

FIG. 10 is a block diagram of a semiconductor device 3C according to further another modification. Components similar to those previously described will be denoted by similar reference signs. The detailed description of these components will not be repeated.

The semiconductor device 3C includes a control unit 21C. The control unit 21C writes and reads measurements into and from the storage device 5 and supplies the measurements read from the storage device 5 to the calculation unit 8. The control unit 21C also supplies the ambient-light illuminance calculated by the calculation unit 8 to the communication interface 22. The communication interface 22 also sends the ambient-light illuminance calculated by the calculation unit 8 to the display circuit 13, which controls the display panel 2.

Second Preferred Embodiment

The following describes another preferred embodiment of the present invention. It is noted that for convenience in description, components having the same functions as components described in the foregoing preferred embodiment will be denoted by the same signs, and their description will not be repeated.

Figure 11:
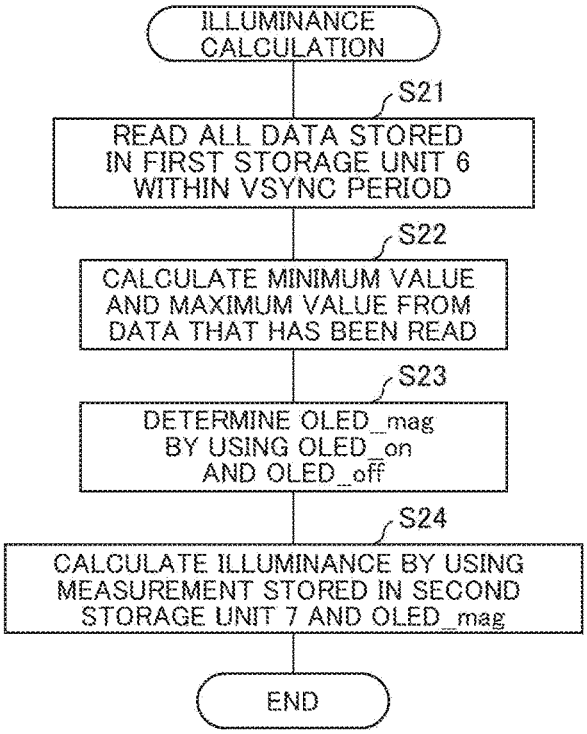
FIG. 11 is a flowchart showing the operation of an electronic apparatus according to a second preferred embodiment.

FIG. 11 is a flowchart showing the operation of an electronic apparatus according to the second preferred embodiment.

In the second preferred embodiment, no address information synchronizing with the vertical synchronizing signal S1 is provided; the ambient-light illuminance is calculated by reading measurements during all the first measurement periods T1 between the vertical synchronizing signals S1.

The following describes the operation of the electronic apparatus according to the second preferred embodiment that includes the semiconductor device 3C shown in FIG. 10. The control unit 21C reads (Step S21) all first measurements stored in addresses of 0 to 31 of the first storage unit 6 within a period between the vertical synchronizing signals S1. Next (Step S22), the calculation unit 8 selects a maximum value and a minimum value from among all the first measurements within the period between the vertical synchronizing signals S1.

Next (Step S23), the calculation unit 8 sets the maximum value to a first measurement OLED_ON, sets the minimum value to a first measurement OLED_OFF and determines the light emission intensity, OLED_mag, of each of the light-emitting elements 17R, 17G and 17B on the basis of the first measurement OLED_ON and first measurement OLED_OFF.

Then (Step S24), the calculation unit 8 calculates the ambient-light illuminance through foregoing Expression 2 by using a second measurement and the light emission intensity OLED_mag of each of the light-emitting elements 17R, 17G and 17B.

The communication interface 22 then sends the ambient-light illuminance calculated by the calculation unit 8 to the display circuit 13, which controls the display panel 2.

When the electronic apparatus according to the second preferred embodiment includes the semiconductor device 3B shown in FIG. 9, the calculation unit 8 reads all the first measurements stored in the first storage unit 6. When the electronic apparatus includes the semiconductor device 3 shown in FIG. 3, the communication interface 22 reads all the first measurements stored in the first storage unit 6. When the electronic apparatus includes the semiconductor device 3A shown in FIG. 4, the control unit 21A reads all the first measurements stored in the first storage unit 6.

As described above, the calculation unit 8 selects a maximum value and a minimum value from among the first measurements read from the first storage unit 6 and calculates the light emission illuminance of each of the light-emitting elements 17R, 17G and 17B by subtracting the minimum value from the maximum value.

Third Preferred Embodiment

Figure 12:
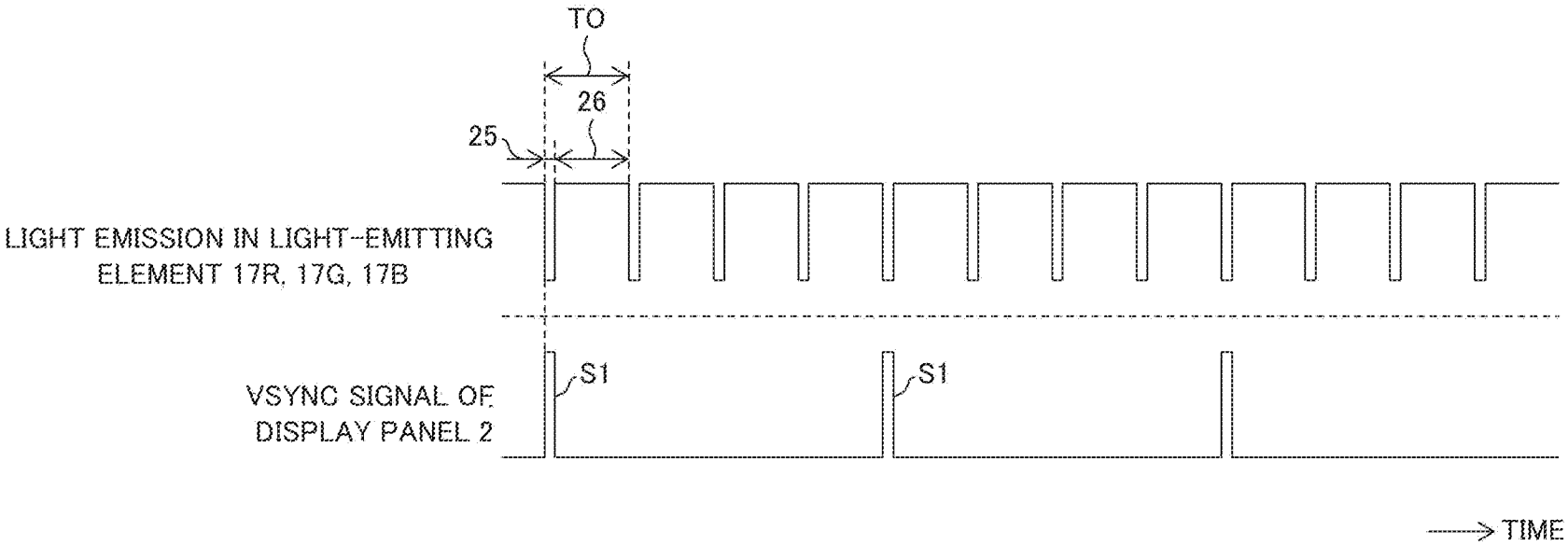
FIG. 12 is a graph for describing the operation of an electronic apparatus according to a third preferred embodiment.
Figure 13:
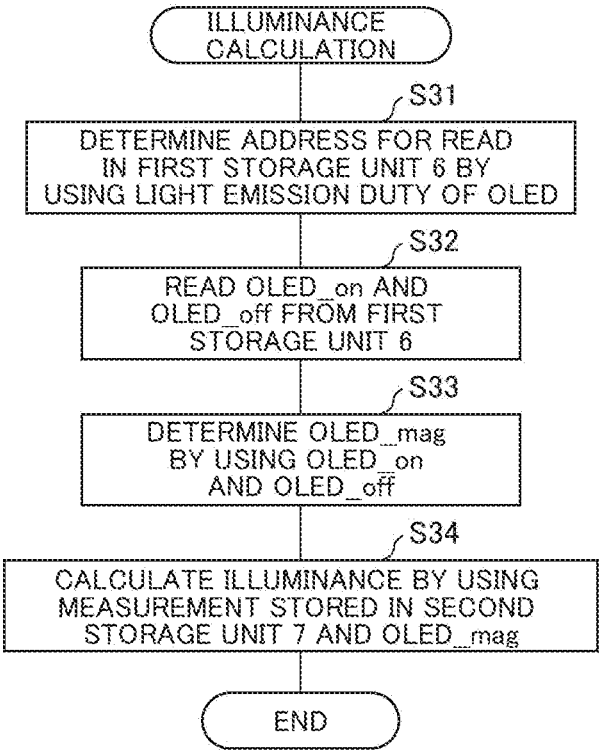
FIG. 13 is a flowchart showing the operation of the electronic apparatus.

FIG. 12 is a graph for describing the operation of an electronic apparatus according to the third preferred embodiment. FIG. 13 is a flowchart showing the operation of the electronic apparatus. Components similar to those previously described will be denoted by similar reference signs. Their detailed description will not be repeated.

The third preferred embodiment describes how to calculate the ambient-light illuminance when the light emission in each of the light-emitting elements 17R, 17G and 17B does not completely turn off.

FIG. 12 illustrates a case where the light emission in each of the light-emitting elements 17R, 17G and 17B does not completely turn off during the OFF period 25. In this case, the reflected light 24 based on light emitted from each of the light-emitting elements 17R, 17G and 17B is added to the ambient light 23 and then enters the light measuring instrument 4 during the OFF period 25, thus compensating for the ambient-light illuminance with a predetermined compensation coefficient based on light that always enters the light measuring instrument 4.

The following describes an instance where the electronic apparatus according to the third preferred embodiment includes the semiconductor device 3C shown in FIG. 10.

Firstly, first measurements are measured by the light measuring instrument 4 during the first measurement periods T1 in synchronization with the vertical synchronizing signal S1 of the display panel 2, and a second measurement is measured by the light measuring instrument 4 during the second measurement period T2 in synchronization with the vertical synchronizing signal S1. Then, the control unit 21C stores the first measurements in the first storage unit 6 in order from the start address and stores the second measurement in the second storage unit 7. Then (Step S31), the control unit 21C determines addresses for read in the first storage unit 6 by using the light emission duty of each of the light-emitting elements 17R, 17G and 17B.

Then (Step S32), the control unit 21C reads the first measurements OLED_ON and the first measurements OLED_OFF from the first storage unit 6 and reads the second measurement from the second storage unit 7.

Next (Step S33), the calculation unit 8 determines the light emission intensity OLED_mag of each of the light-emitting elements 17R, 17G and 17B on the basis of the first measurements OLED_ON and the first measurements OLED_OFF.

Then (Step S34), the calculation unit 8 calculates the ambient-light illuminance through Expression 3 below by using the second measurement and the light emission intensity OLED_mag of each of the light-emitting elements 17R, 17G and 17B.

$$\text{Ambient-light illuminance} = \text{measurement in second storage unit} - \text{OLDE_mag} \times (\text{second measurement period } T2/(\text{first measurement period } T1 \times 2)) - \text{compensation coefficient} \qquad \text{Expression 3}$$

The above compensation coefficient is a coefficient corresponding to light that always enters the light measuring instrument 4 during the OFF period 25 and the ON period 26. The compensation coefficient is a value that depends on the size of the light measuring instrument 4 and the luminance of the display panel 2 and is a value that is determined in advance through actual measurement.

As described above, when the light emission in each of the light-emitting elements 17R, 17G and 17B does not completely turn off, the calculation unit 8 calculates the ambient-light illuminance in accordance with a compensation coefficient that is for compensating for the influence of light that is always input to the light measuring instrument 4.

Implementation by Software

The functions of the calculation unit 8 and control unit 21 (hereinafter referred to as a devise) in the electronic apparatus 1 can be implemented by programs that are for a computer to function as the device and that are for the computer to function as each control block in the device.

The device in this case includes a computer that has, as hardware for executing the programs, at least one control device (e.g., a processor) and at least one storage device (e.g., a memory). Executing the programs by using these control device and storage device implements the functions described in the foregoing respective preferred embodiments.

The programs may be stored in one or more non-transitory computer-readable storage media. These storage media may or may not be included in the foregoing device. When the storage media are not included in the device, the programs may be supplied to the device via any wired or wireless transmission medium.

The function of each control block in part or in whole can be implemented by a logic circuit. For instance, an integrated circuit provided with logic circuits that function as the individual control blocks is also included in the scope of the present invention. Other than the foregoing, the functions of the individual control blocks can be implemented by a quantum computer for instance.

SUMMARY

A semiconductor device 3A according to a first aspect of the present invention includes the following: a light measuring instrument 4 disposed opposite a display surface 18 of a display panel 2 provided with a self-emission element (light-emitting element 17R, 17G, 17B), and disposed for measuring the ambient-light illuminance of the display panel 2; a storage device 5 configured to store a plurality of first measurements measured by the light measuring instrument 4 in synchronization with a synchronizing signal (vertical synchronizing signal S1) of the display panel 2 during a plurality of first measurement periods T1 that are shorter than an ON/OFF period T0 of the self-emission element (light-emitting element 17R, 17G, 17B); and a calculation unit 8 configured to calculate the light emission illuminance of the self-emission element (light-emitting element 17R, 17G, 17B) in accordance with the plurality of first measurements stored in the storage device 5, and configured to calculate the ambient-light illuminance by subtracting a value based on the light emission illuminance from a second measurement measured by the light measuring instrument 4 during a second measurement period T2 that is longer than the plurality of first measurement periods T1.

In the foregoing configuration, the light measuring instrument, disposed opposite the display surface of the display panel provided with the self-emission element, measures the first measurements in synchronization with the synchronizing signal of the display panel during the first measurement periods, which are shorter than the ON/OFF period of the self-emission element. The first measurements measured by the light measuring instrument are then stored in the storage device. The light emission illuminance of the self-emission element is next calculated in accordance with the first measurements stored in the storage device. The ambient-light illuminance is then calculated by subtracting the value based on the light emission illuminance from the second measurement, measured by the light measuring instrument during the second measurement period, which is longer than the first measurement periods.

Accordingly, the light emission illuminance of the self-emission element can be subtracted accurately from the second measurement, measured by the light measuring instrument during the second measurement period, in accordance with the synchronizing signal of the display panel. This can achieve a semiconductor device that can calculate more accurate ambient-light illuminance.

The semiconductor device 3A according to a second aspect of the present invention is preferably configured, in the first aspect, such that the calculation unit 8 calculates the light emission illuminance of the self-emission element (light-emitting element 17R, 17G, 17B) by subtracting, based on a light emission duty of the self-emission element (light-emitting element 17R, 17G, 17B), the plurality of first measurements with the self-emission element (light-emitting element 17R, 17G, 17B) remaining off from the plurality of first measurements with the self-emission element (light-emitting element 17R, 17G, 17B) remaining on.

The foregoing configuration enables the light emission illuminance of the self-emission element to be subtracted accurately based on the light emission duty of the self-emission element.

The semiconductor device 3A according to a third aspect of the present invention is preferably configured, in the first aspect, such that the calculation unit reads the plurality of first measurements stored in the storage device, selects a maximum value and a minimum value from among the plurality of first measurements read, and calculates the light emission illuminance of the self-emission element by subtracting the minimum value from the maximum value.

The foregoing configuration eliminates the need for address information about the first measurements based on the synchronizing signal of the display panel and on the light emission duty of the self-emission element, thereby enabling the light emission illuminance of the self-emission element to be subtracted with a simple configuration.

The semiconductor device 3A according to a fourth aspect of the present invention is preferably configured, in any one of the first to third aspects, such that when the light emission in the self-emission element (light-emitting element 17R, 17G, 17B) does not completely turn off, the calculation unit 8 calculates the ambient-light illuminance in accordance with a compensation coefficient for compensating for the influence of light that is always input to the light measuring instrument 4.

The foregoing configuration enables calculation of the ambient-light illuminance of a display panel that includes a self-emission element where illuminance does not stand at zero during an OFF period.

The semiconductor device 3A according to a fifth aspect of the present invention is preferably configured, in the second aspect, such that the ON/OFF TO period includes an ON period 26 during which the self-emission element (light-emitting element 17R, 17G, 17B) remains on, and an OFF period 25 during which the self-emission element (light-emitting element 17R, 17G, 17B) remains off, such that some of the plurality of first measurement periods T1 are ON measurement periods T3 for measurement during the ON period 26, some of the plurality of first measurement periods T1 are OFF measurement periods T4 for measurement during the OFF period 25, and the plurality of remaining first measurement periods T1 are transient measurement periods 25 during which the ON period 26 possibly switches to the OFF period 25, or the OFF period 25 possibly switches to the ON period 26, such that the storage device 5 stores the plurality of first measurements in order from a start address, and such that the calculation unit 8 calculates the light emission illuminance of the self-emission element (light-emitting element 17R, 17G, 17B) by subtracting the plurality of first measurements measured during the OFF measurement periods T4 from the plurality of first measurements measured during the ON measurement periods T3.

The foregoing configuration enables the first measurements with the self-emission element remaining off to be subtracted from the first measurements with the self-emission element remaining on.

The semiconductor device 3A according to a sixth aspect of the present invention is configured, in the second aspect, such that the calculation unit 8 calculates the ambient-light illuminance by subtracting, from the second measurement, a value based on the light emission illuminance, the plurality of first measurement periods T1 and the second measurement period T2.

The foregoing configuration enables calculation of more accurate ambient-light illuminance.

The semiconductor device 3A according to a seventh aspect of the present invention is preferably configured, in any one of the first to sixth aspects, such that the storage device 5 includes a first storage unit 6 configured to store the plurality of first measurements, and a second storage unit 7 configured to store the second measurement.

The foregoing configuration enables the ambient-light illuminance to be calculated based on the first measurements stored in the first storage unit and the second measurement stored in the second storage unit.

A semiconductor device 3 according to an eighth aspect of the present invention includes the following: a light measuring instrument 4 disposed opposite a display surface 18 of a display panel 2 provided with a self-emission element (light-emitting element 17R, 17G, 17B), and disposed for measuring the ambient-light illuminance of the display panel 2; a storage device 5 configured to store a plurality of first measurements measured by the light measuring instrument 4 in synchronization with a synchronizing signal (vertical synchronizing signal S1) of the display panel 2 during a first measurement period T1 that is shorter than an ON/OFF period T0 of the self-emission element (light-emitting element 17R, 17G, 17B); and a communication interface 22 configured to calculate the light emission illuminance of the self-emission element (light-emitting element 17R, 17G, 17B) in accordance with the plurality of first measurements, and configured to send the plurality of first measurements and a second measurement for subtracting a value based on the light emission illuminance from the second measurement measured by the light measuring instrument 4 during a second measurement period T2 that is longer than the first measurement period T1.

An electronic apparatus 1 according to a ninth aspect of the present invention includes the following: a display panel 2 provided with a self-emission element (light-emitting element 17R, 17G, 17B); and a semiconductor device 3 disposed opposite a display surface 18 of the display panel 2, wherein the semiconductor device 3 includes the following: a light measuring instrument 4 for measuring the ambient-light illuminance of the display panel 2; a storage device configured to store a plurality of first measurements measured by the light measuring instrument 4 in synchronization with a synchronizing signal (vertical synchronizing signal S1) of the display panel 2 during a first measurement period T1 that is shorter than an ON/OFF TO period of the self-emission element (light-emitting element 17R, 17G, 17B); and a calculation unit 8 configured to calculate light emission illuminance of the self-emission element (light-emitting element 17R, 17G, 17B) in accordance with the plurality of first measurements stored in the storage device 5, and configured to calculate the ambient-light illuminance by subtracting a value based on the light emission illuminance from a second measurement measured by the light measuring instrument 4 during a second measurement period T2 that is longer than the first measurement period T1.

A method for measuring ambient-light illuminance according to a tenth aspect of the present invention is for measuring the ambient-light illuminance of a display panel 2 provided with a self-emission element (light-emitting element 17R, 17G, 17B). The method includes the following process steps: storing, in a storage device 5, a plurality of first measurements measured by a light measuring instrument 4 disposed opposite a display surface 18 of the display panel 2 in synchronization with a synchronizing signal (vertical synchronizing signal S1) of the display panel 2 during a first measurement period that is shorter than an ON/OFF period TO of the self-emission element (light-emitting element 17R, 17G, 17B); and calculating the light emission illuminance of the self-emission element (light-emitting element 17R, 17G, 17B) in accordance with the plurality of first measurements stored in the storage device 5, and calculating the ambient-light illuminance by subtracting a value based on the light emission illuminance from a second measurement measured by the light measuring instrument 4 during a second measurement period T2 that is longer than the first measurement period T1.

A non-transitory computer-readable medium according to an eleventh aspect of the present invention stores a program based on the method for measuring the ambient-light illuminance according to the tenth aspect of the present invention.

The present invention is not limited to the foregoing preferred embodiments. Various modifications can be devised with the scope of the claims. A preferred embodiment that is obtained in combination, as appropriate, with the technical means disclosed in the respective preferred embodiments is also included in the technical scope of the present invention. Furthermore, combining the technical means disclosed in the respective preferred embodiments can form a new technical feature.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A semiconductor device comprising:

a light measuring instrument disposed opposite a display surface of a display panel provided with a self-emission element, and disposed for measuring ambient-light illuminance of the display panel;

a storage device configured to store a plurality of first measurements measured by the light measuring instrument in synchronization with a synchronizing signal of the display panel during a plurality of first measurement periods that are shorter than an ON/OFF period of the self-emission element; and a calculation unit configured to calculate light emission illuminance of the self-emission element in accordance with the plurality of first measurements stored in the storage device, and configured to calculate the ambient-light illuminance by subtracting a value based on the light emission illuminance from a second measurement measured by the light measuring instrument during a second measurement period that is longer than the plurality of first measurement periods.

2. The semiconductor device according to claim 1, wherein the calculation unit calculates the light emission illuminance of the self-emission element by subtracting, based on a light emission duty of the self-emission element, the plurality of first measurements with the self-emission element remaining off from the plurality of first measurements with the self-emission element remaining on.

3. The semiconductor device according to claim 2, wherein the ON/OFF period includes an ON period during which the self-emission element remains on, and an OFF period during which the self-emission element remains off, a first set of the plurality of first measurement periods are ON measurement periods for measurement during the ON period, a second set of the plurality of first measurement periods are OFF measurement periods for measurement during the OFF period, and first measurement periods in the plurality of first measurement periods other than the first and second sets of the plurality of first measurement periods are transient measurement periods during which the ON period is switchable to the OFF period, or the OFF period is switchable to the ON period, the storage device stores the plurality of first measurements in an order from a start address, and the calculation unit calculates the light emission illuminance of the self-emission element by subtracting the second set of the plurality of first measurements measured during the OFF measurement periods from the first set of the plurality of first measurements measured during the ON measurement periods.

4. The semiconductor device according to claim 2, wherein the calculation unit calculates the ambient-light illuminance by subtracting, from the second measurement, a value based on the light emission illuminance, the plurality of first measurement periods, and the second measurement period.

5. The semiconductor device according to claim 1, wherein the calculation unit reads the plurality of first measurements stored in the storage device, selects a maximum value and a minimum value from among the plurality of first measurements read, and calculates the light emission illuminance of the self-emission element by subtracting the minimum value from the maximum value.

6. The semiconductor device according to claim 1, wherein when light emission in the self-emission element does not completely turn off, the calculation unit calculates the ambient-light illuminance in accordance with a compensation coefficient for compensating for an influence of light that is always input to the light measuring instrument.

7. The semiconductor device according to claim 1, wherein the storage device includes a first storage unit configured to store the plurality of first measurements, and a second storage unit configured to store the second measurement.

8. A semiconductor device comprising:

a light measuring instrument disposed opposite a display surface of a display panel provided with a self-emission element, and disposed for measuring ambient-light illuminance of the display panel;

a storage device configured to store a plurality of first measurements measured by the light measuring instrument in synchronization with a synchronizing signal of the display panel during a plurality of first measurement periods that are shorter than an ON/OFF period of the self-emission element; and a communication interface configured to calculate light emission illuminance of the self-emission element in accordance with the plurality of first measurements, and configured to send the plurality of first measurements and a second measurement for subtracting a value based on the light emission illuminance from the second measurement measured by the light measuring instrument during a second measurement period that is longer than the plurality of first measurement periods.

9. An electronic apparatus comprising:

a display panel provided with a self-emission element; and a semiconductor device disposed opposite a display surface of the display panel, wherein the semiconductor device includes:

a light measuring instrument for measuring ambient-light illuminance of the display panel, a storage device configured to store a plurality of first measurements measured by the light measuring instrument in synchronization with a synchronizing signal of the display panel during a plurality of first measurement periods that are shorter than an ON/OFF period of the self-emission element, and a calculation unit configured to calculate light emission illuminance of the self-emission element in accordance with the plurality of first measurements stored in the storage device, and configured to calculate the ambient-light illuminance by subtracting a value based on the light emission illuminance from a second measurement measured by the light measuring instrument during a second measurement period that is longer than the plurality of first measurement periods.

* * * * *